US007137432B2

(12) United States Patent
Senk, Jr. et al.

(10) Patent No.: US 7,137,432 B2
(45) **Date of Patent: *Nov. 21, 2006**

(54) SAND-FORMING APPARATUS

(75) Inventors: Gerald B. Senk, Jr., Lagrange, OH (US); Steven J. Sigl, Mentor, OH (US)

(73) Assignee: Equipment Merchants International, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/257,253

(22) Filed: Oct. 24, 2005

(65) Prior Publication Data

US 2006/0032599 A1 Feb. 16, 2006

Related U.S. Application Data

(63) Continuation of application No. PCT/US04/12743, filed on Apr. 23, 2004.

(51) Int. Cl.
*B22C 9/10* (2006.01)
*B22C 9/12* (2006.01)
*B22C 15/24* (2006.01)

(52) U.S. Cl. ..... 164/16; 164/21

(58) Field of Classification Search ..... 164/16, 164/19–21, 200–202
See application file for complete search history.

(56) References Cited

U.S. PATENT DOCUMENTS 3,461,948 A 8/1969 Londal et al. ..... 164/201
4,836,269 A 6/1989 Bellis et al. ..... 164/200
5,787,957 A 8/1998 Nagarwalla et al. ..... 164/16
6,866,083 B1 * 3/2005 Senk et al. ..... 164/16

FOREIGN PATENT DOCUMENTS

| | | |
|---|---|---|
| EP | 259 557 | 3/1988 |
| EP | 480 164 | 4/1992 |
| EP | 815 986 | 1/1998 |
| EP | 844 036 | 5/1998 |

OTHER PUBLICATIONS

EP 04 75 0629; Supplementary European Search Report dated May 22, 2006.

* cited by examiner

*Primary Examiner*—Kuang Y. Lin
(74) *Attorney, Agent, or Firm*—Renner, Otto, Boisselle & Sklar, LLP

(57) ABSTRACT

A sand-forming apparatus (10) comprising a sand magazine (12), a manifold (14), a core box (16) defining a cavity (18), a clamp table (20), and a blow tube assembly (22). The apparatus (10) is convertible from a sand-blowing state to a catalyst-introducing state without removal of the blow tube assembly (22) and/or un-clamping of the tool package (e.g., the manifold (14) and the cope/drag halves of the core box (16)). In the sand-blowing state, sand is blown from the magazine (12) into the cavity (18) and, in the catalyst-introducing state, the catalyst is introduced into the blown sand in the cavity (18) to solidify the sand into a sand-shape. Molten metal can be poured into or around the sand-shape formed by the apparatus (10) and, upon completion of casting the metal part, the sand-shape can be removed.

20 Claims, 6 Drawing Sheets

SAND-FORMING APPARATUS

RELATED APPLICATION

This application is a continuation of International Application No. PCT/US04/12743, which claimed priority to U.S. application Ser. No. 10/423,377, now issued as U.S. Pat. No. 6,866,083. The entire disclosures of these applications is hereby incorporated by reference.

FIELD OF THE INVENTION

The present invention relates generally as indicated to a sand-forming apparatus, which is an apparatus that forms a solidified sand-shape for use in the subsequent casting of a metal part.

BACKGROUND OF THE INVENTION

When casting a metal part having cavities, openings, surfaces or paths, it is common in the foundry industry to use solidified sand-shapes to acquire the desired interior and/or exterior geometry. Such sand-shapes can be used singularly or in combination in a casting operation. Specifically, the cast part is formed by pouring molten metal into or around the sand-shape. Upon completion of casting the metal part, the sand-shape(s) is(are) broken down, shaken-out, de-solidified or otherwise removed from the metal part. Accordingly, the casting process often begins with the forming of one or more sand-shapes corresponding to the desired geometry of the to-be-cast metal part.

A sand-shape (e.g., a sand core or a sand mold) is typically formed in a core box comprising a cope and drag, which define a cavity of the desired geometry therebetween. The core box is designed for receipt of a blow tube assembly that conveys prepared sand (e.g., conditioned with chemicals or resins so that it remains flowable) from a sand magazine into the cavity. The core box also can have vent passages in its cope and/or drag to allow air to escape from the cavity as it is filled with sand.

After the sand is blown into the cavity, the blow tube assembly is withdrawn from the core box. The exiting of the blow tube often tends to create a slight pile of sand in the cope just above the cavity from excess sand falling out of the blow tube due to the angle of repose. To avoid imperfections on the cope side of the finished sand-shape, the industry norm is to pat or tamp these little piles of sand with tamper pins prior to the catalyst-solidifying steps.

After removal of the blow tube assembly (which is fastened to the sand magazine via the blow plate), a gassing manifold is subsequently positioned over the core box to form a sealed chamber, which covers the blow tube opening and the cope passages. Tamping steps are usually performed at this point with pins, which hang from a plate inside the manifold chamber. Cylinders or springs typically actuate the tamper plate movement. A solidifying catalyst then is introduced through inlet ports in the manifold, travels through the blow tube cope opening and core vent passages, and then exits through the drag vent passages. After an appropriate curing time, the cavity is purged with air to remove any residual catalyst vapors. The core box may then be separated for the ejection and removal of the cured sand-shape.

It may be noted that between the sand-blowing steps and the catalyst-introducing steps, a conventional sand-forming apparatus necessitates the withdrawal of the blow tube assembly and transfer of the manifold. It may also be noted that the current trend in the industry is to encompass all of the sand-forming components (e.g., the sand supply magazine, the cope box, the manifold etc.) in an enclosure, thereby providing a segregated area for exhausting catalyst vapors. While such an enclosure may shield the outside environment from the undesirable vapors, it does not prevent residual catalyst vapors from unintentionally curing the remaining sand in the blow tube assembly or the sand magazine.

In the past, sand-forming methods have been proposed and/or attempted that would enable the sand-blowing steps and catalyst-introducing steps to be performed with the same equipment. These proposed/attempted methods experienced very limited (if any) success and were not without significant drawbacks. For example, the modification of the sand blow plate to allow for catalyst passages to be introduced along side each of the blow tube had been proposed. However, this modification did not provide any way of preventing contamination and hardening of sand contained in the blow tube. The replacement of conventional core boxes with ones having complicated drill patterns, bladder sealing, and indirect blowing paths also have been proposed. However, these proposals require an industry-wide scrap of literally all existing core boxes (or at least the cope halves) and, moreover, do not provide uniform sand distribution from the end of the blow tube. Special blow tubes also have been attempted, with lateral blowing and gassing exits to feed peripheral areas of the cores.

All in all, these proposed and attempted solutions fail to provide uniform sand distribution (i.e., they fail to fill below the tube adequately) to fill the core box in a conventional manner, fail to make use of existing common and accepted core box designs, fail to accommodate ventilation through the top side of the cope, and/or fail to address the need for tamping prior to catalyst-introducing steps. Moreover, past proposed and attempted methods have failed to provide these features while also providing for controlled containment of the catalyst.

SUMMARY OF THE INVENTION

The present invention provides a sand-forming apparatus wherein sand-blowing steps and catalyst-introducing steps can be performed without removal of a blow tube assembly and/or transfer of a gassing manifold. The sand-forming apparatus of the present invention also can provide uniform sand distribution from the end of the blow tube to fill the core box in a conventional manner, is compatible with existing core box tooling equipment, can accommodate ventilation through the top side of the cope, and/or can accomplish tamping prior to catalyst-introducing steps. Moreover, these features are provided while also providing a controlled containment of the catalyst.

More particularly, the present invention provides a sand-forming apparatus comprising a core box, with a cavity having a shape corresponding to a desired sand-shape, and a blow tube assembly. The blow tube assembly comprises a sand passageway through which sand is blown into the cavity, a catalyst passageway for the introduction of catalyst into the sand blown into the cavity, and sealing between the sand passageway and the catalyst passageway, whereby sand in the sand passageway is isolated from the catalyst in the catalyst passageway. The apparatus is convertible between a sand-blowing state, whereat sand is blown into the cavity through the sand passageway, and a catalyst-introducing state, whereat catalyst is introduced to the blown sand in the cavity.

The blow tube assembly can comprise an inner tube and an outer tube, which at least partially surrounds the inner tube. The relative movement between the inner tube and the outer tube converts the assembly between a sand-blowing position and a catalyst-introducing position. When in the sand-blowing position, the sand passageway communicates with the cavity and the catalyst passageway is sealed from a catalyst supply. When in the catalyst-introducing position, the catalyst-introducing passage communicates with the catalyst supply and the sand passageway is sealed from the cavity. The inner tube also tamps the blown sand as the assembly is converted from the sand-blowing position to the catalyst-introducing position.

The inner tube can be mounted (e.g., adjustably mounted) to the sand magazine, and the outer tube can be mounted (e.g., adjustably mounted) to the manifold. In this manner, relative movement between the sand magazine and the manifold converts the apparatus between a sand-blowing state and a catalyst-introducing state. The manifold remains continuously clamped to the core box when sand is being blown into the cavity, and the blow tube assembly remains received in the manifold and core box when catalyst is being introduced into the sand blown cavity. Thus, prior to and during the catalyst-introducing steps, the uncured core is not disturbed by machine motions and/or equipment transfers.

These and other features of the invention are fully described and particularly pointed out in the claims. The following description and annexed drawings set forth in detail a certain illustrative embodiment of the invention, this embodiment being indicative of but one of the various ways in which the principles of the invention may be employed.

DRAWINGS

DETAILED DESCRIPTION

Figure 1B:
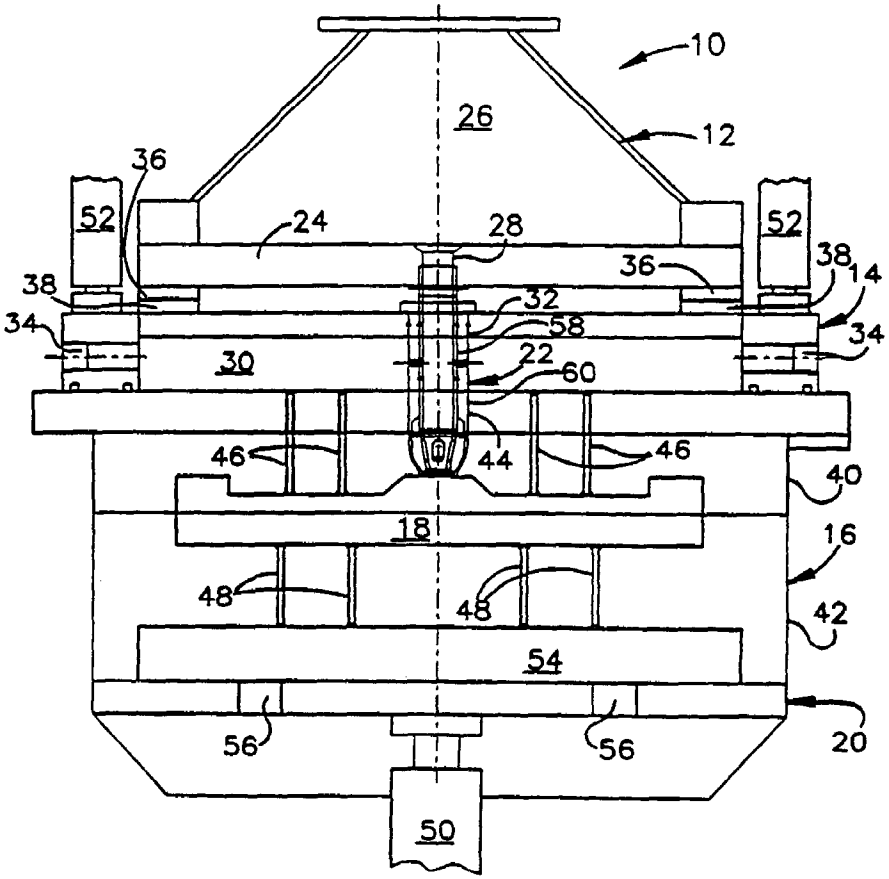
FIGS. 1A and 1B are side schematic views of a sand-forming apparatus according to the present invention, the apparatus being shown in its sand-blowing state and its catalyst-introducing state, respectively.
Figure 1A:
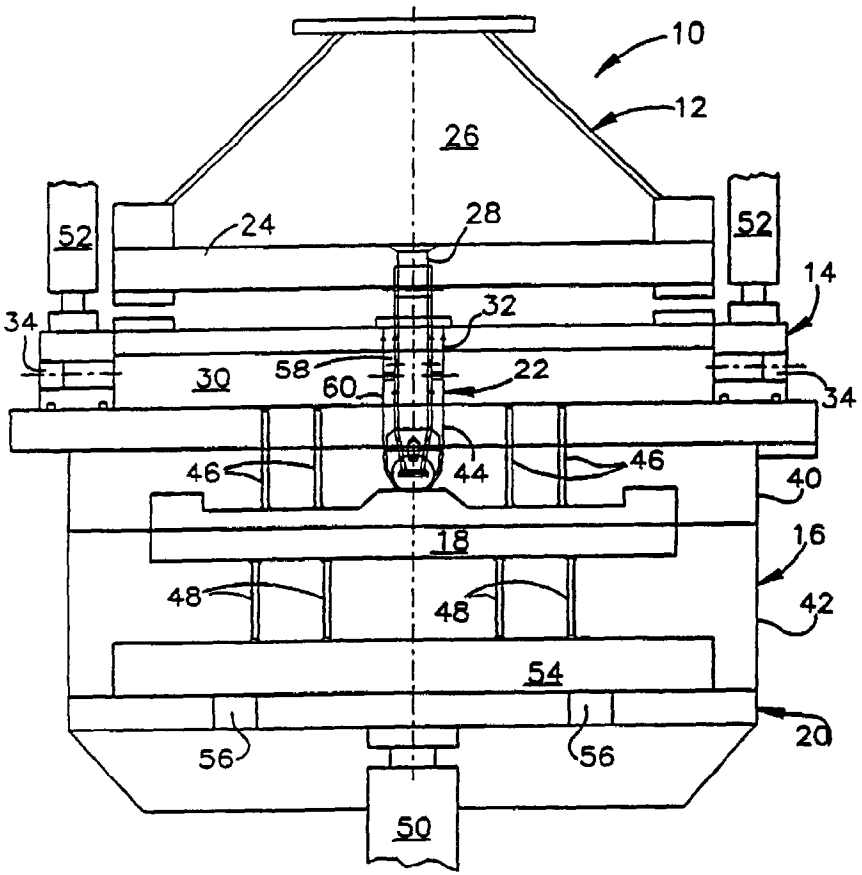

Referring now to the drawings in detail, and initially to FIGS. 1A and 1B, a sand-forming apparatus 10 according to the present invention is shown. The sand-forming apparatus 10 comprises a sand magazine 12, a gassing manifold 14, a core box 16 defining a cavity 18, a clamp table 20, and a blow tube assembly 22. The apparatus 10 is convertible from a sand-blowing state (FIG. 1A) to a catalyst-introducing and purging state (FIG. 1B) without removal of the blow tube assembly 22 and/or unclamping of the tool package (e.g., the manifold 14 and the cope/drag halves of the core box 16). In the sand-blowing state, sand is blown from the magazine 12 into the cavity 18 to fill it with compressed sand to form a sand-shape. In the catalyst-introducing and purging state, the catalyst is introduced into the sand-shape now occupying the cavity 18 and thereafter purged therefrom.

The illustrated sand magazine 12 comprises upper wall members and a plate 24, which together define a sand-containing space 26. Prepared sand (e.g., sand pre-mixed with the appropriate chemicals, resins, or binders so that it may remain flowable and is curable by catalysts in a gaseous or liquid state) is contained within the space 26 and rests on top of the plate 24. The plate 24 coordinates with the blow tube assembly 22 (whereby it is sometimes referred to as a "blow plate") and, to this end, includes an opening 28 for receipt of the blow tube assembly 22. The opening 28 is also used to mount a component of the blow tube assembly 22 (namely a tube 58, introduced below), whereby its lower portion may be threaded. It may further be noted that the top of the opening 28 can be flared to facilitate the flow of sand.

The illustrated gassing manifold 14 comprises wall members which, together with the upper surface of the core box 16, define a sealed chamber 30. The upper wall member has an opening 32 for receipt of the blow tube assembly 22 and for mounting of a component (namely a tube 60, introduced below) of the blow tube assembly 22. The upper portion of the opening 32 can be threaded or flanged for mounting purposes.

The side wall members include inlet/outlet ports 34, which communicate with the manifold chamber 30. The ports 34 function as outlets for air evacuation during sand-blowing steps and also function as inlets for catalyst and purge air during catalyst-introducing and purging steps. Typically, the ports 34 would be connected to a catalyst-producing machine (e.g., a gas generator), with bypass or dual purpose paths being provided for a purge-fluid supply and an exhaust air drain. In any event, this design allows the manifold 14 to remain stationary relative to the core box 16 throughout sand-blowing, exhausting, tamping, catalyst-introducing, and purging steps.

Stops 36 can be provided on the lower surface of the blow plate 24 and corresponding stops 38 can be provided on the upper surface of the manifold 14. The stops 36 and 38 can be positioned preferably to distribute loading in a uniform way and/or preferably can be shaped and sized similarly. The distance between the stops 36 and 38 is controlled by raising the clamp table 20 and/or lowering the sand magazine 12. It may be noted that in either or both cases, the manifold 14 can remain sealingly clamped to the core box 16, and the cope/drag halves of the core box 16 can remain stationary relative to each other.

When the assembly 10 is in its sand-blowing state, there is a predetermined space between the stops 36 and 38 (FIG. 1A). When the assembly 10 is in its catalyst-introducing state, there is a lesser space (e.g., none) between the stops 36 and 38 (FIG. 1B). It may be noted for future reference that the initial spacing between the stops 36 and 38 (FIG. 1A) sets the initial sand-blowing position, sets the relative positioning parameters between blow tube components (namely tubes 58 and 60, introduced below), and sets the tamping height.

The illustrated core box 16 comprises a cope 40 and a drag 42, which together define the cavity 18. In the illustrated apparatus 10, the core box 16 is horizontally parted; that is, it has a top cope 40 and a bottom drag 42. However, it may be noted that the present invention could be used (with appropriate orientation modifications to the apparatus 10) in conjunction with vertically parted or other non-horizontally parted core boxes. In the illustrated core box 16, the cope 40 includes an opening 44, which extends from the top of the core box 16 to the cavity 18. The opening 44 is aligned with the magazine's opening 28 and the manifold's opening 32, and is sized and shaped for receipt of a portion of the blow tube assembly 22.

The cope 40 also includes passages 46, which extend from the cavity 18 to the top of the core box 16 and which communicate with the manifold chamber 30. These passages 46 function as exhaust air outlets (i.e., vents) from the cavity 18 during sand-blowing steps, as catalyst inlets to the cavity 18 during catalyst-introducing steps, and as purge air inlets to the cavity 18 during purging steps. The drag 42 includes passages 48, which extend from the cavity 18 to the bottom of the of the core box 16. These passages 48 function as exhaust air outlets (i.e., vents) from the cavity 18 during sand-blowing steps, as catalyst outlets from the cavity 18 during catalyst-introducing steps, and as purge air outlets from the cavity 18 during purging steps. The passages 46 and 48 are provided with slots, screened, or other suited vents so that only fluids (and perhaps a few sand fines) may travel therethrough.

In the illustrated embodiment, the clamp table 20 is positioned beneath the drag 42, suitably attached thereto (e.g., set, bolted or clamped), and accurately aligned therewith. The table 20 applies continuous clamp pressure via a clamp cylinder 50 and the resultant force can be opposed by an external clamping device 52 on the top side of the manifold 14. The clamping device 52 also can set the spacing between the stops 36 and 38. The clamp table 20 and the core box 16 together can define an exhaust chamber 54 into which the drag passages 48 terminate. Exhaust ports 56 can be provided for the exhaust chamber 54, and the outlet ports 56 can be connected to a vacuum-type collection device (e.g., a scrubber).

The blow tube assembly 22 is aligned with the opening 28 in the sand magazine 12, the opening 32 in the manifold 14, and the opening 44 in the core box 16. The assembly 22 may extend through (or instead just can be aligned with) the magazine opening 28 and extends through the manifold opening 32 and the core box opening 44. In this manner, the blow tube assembly 22 extends from the sand magazine 12 to the cavity 18. The whole assembly 22 is designed to fit into the cope side openings 28, 32 and 44, and seal (via portion 86, introduced below) thereinside once the desired penetration depth has been achieved.

In the illustrated embodiment, the blow tube assembly 22 comprises an inner tube 58 and an outer tube 60, which at least partially surrounds the inner tube 58. The transformation of the sand-forming apparatus 10 from its sand-blowing state to its purging and catalyst-introducing state is accomplished by relative movement between the tubes 58 and 60. Specifically, the inner tube 58 is mounted to the magazine blow plate 24 and the outer tube 60 is mounted to the manifold 14, whereby relative magazine-manifold movement results in the re-positioning of the tubes 58 and 60 relative to each other. When the magazine 12 and the manifold 14 are displaced from each other (i.e., the stops 36 and 38 are separated), the apparatus 10 is in its sand-blowing state (FIG. 1A). When the magazine 12 and the manifold 14 are brought together (i.e., the stops 36 and 38 are abutting), the apparatus 10 is in its catalyst-introducing state (FIG. 1B).

When the apparatus 10 is in its sand-blowing state, the blow tube assembly 22 establishes a sand path from the sand magazine 12 to the cavity 18 and prevents any leakage of sand into the manifold chamber 30. When the apparatus 10 is in its catalyst-introducing and purging state, the blow tube assembly 22 establishes a path from the manifold chamber 30 to the cavity 18 and prevents any leakage of catalyst into excess sand still contained within the assembly 22. The blow tube assembly 22 also functions as a tamping pin during pre-catalyst compacting steps.

Figure 2:
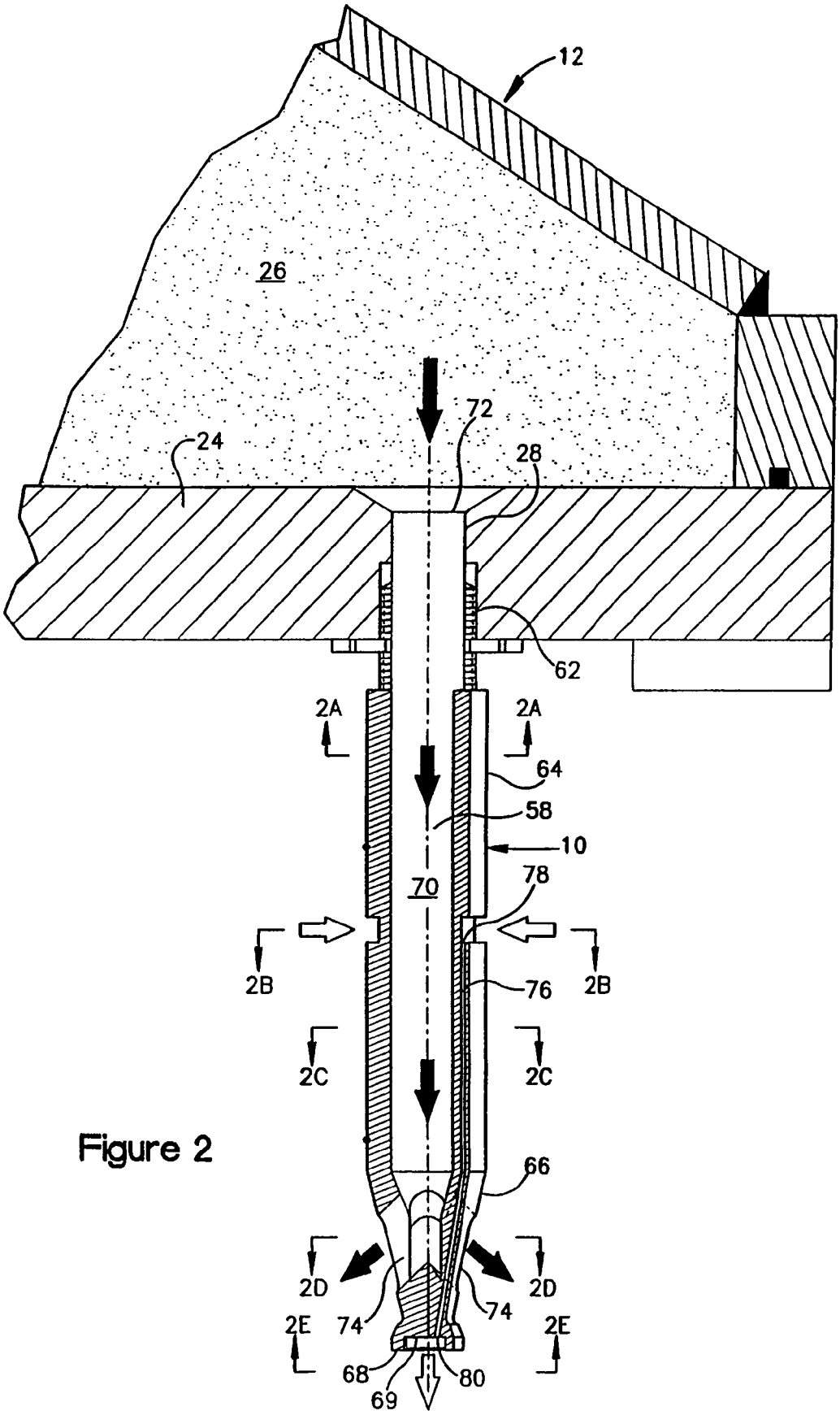
FIG. 2 is an enlarged side schematic view of a component of the sand-forming apparatus, namely an inner blow tube.

Referring now to FIG. 2, the inner tube 58 is shown isolated from the outer tube 60, and the magazine 12 is shown isolated from the other components of the sand-forming apparatus 10. In the illustrated embodiment, the tube 58 comprises an upper threaded mounting portion 62, a central portion 64, and a lower tapered portion 66. The upper portion 62 is screwed into the opening 28 in the blow plate 24 and is secured in place with a lock nut. (It may be noted for future reference that such a threaded mounting arrangement, or a flanged mount with shims, will allow for adjustment of the inner tube 58.) The central portion 64 extends through the manifold 14 (i.e., through the chamber 30 and the opening 32) and partially through the cope 40 of the core box 16.

The lower portion 66 is positioned within the cope 40 adjacent to the cavity 18 and terminates in a tip 68 forming an annular sealing diameter and surrounding a wall 69. The wall 69 can be solid (except for catalyst outlets 80, introduced below) or instead can include screened or slotted venting areas. It may be noted that, although in the illustrated embodiment the bottom surface of the tip 68 has a generally flat (e.g., horizontal) geometry, angled bottom tip surfaces are possible with, and contemplated by, the present invention.

Figure 2A:
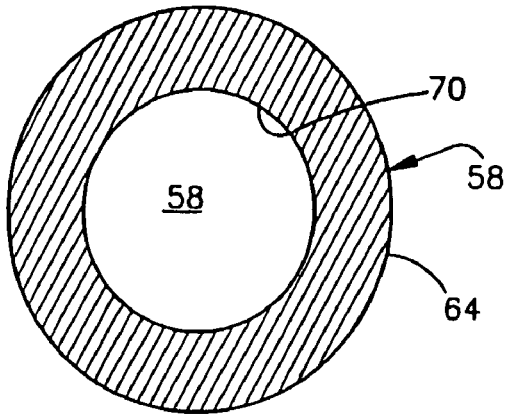
FIGS. 2A–2E are schematic sectional views of the inner blow tube as seen along the corresponding lines in FIG. 2.
Figure 2B:
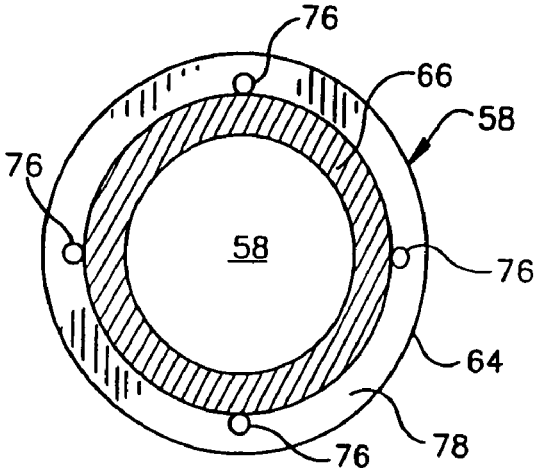
Figure 2C:
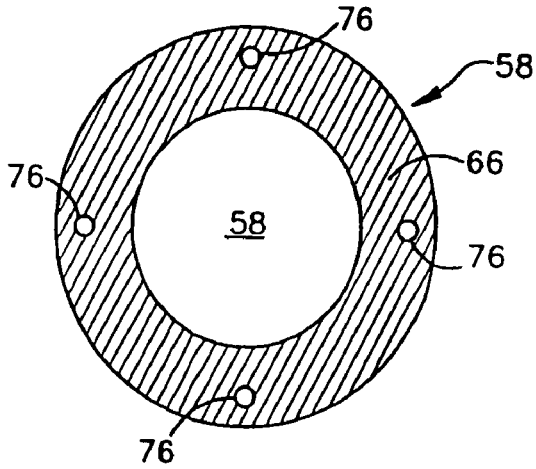
Figure 2D:
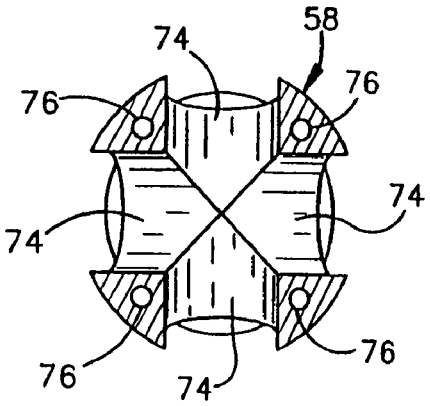
Figure 2E:
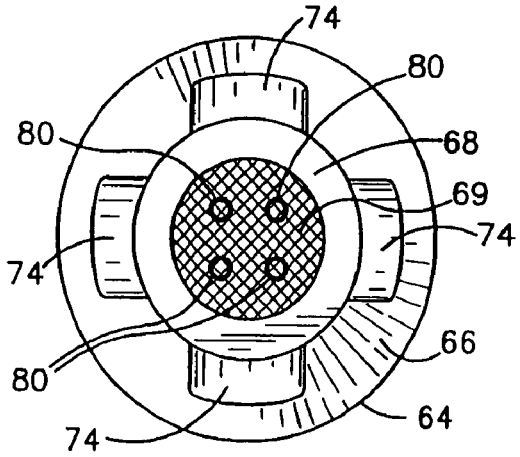

The annular wall of the inner tube 58 defines a sand passageway 70 that extends from a sand inlet 72 communicating with the sand magazine 12 to one or more (e.g., one, two, three, four) sand outlets 74. In the illustrated embodiment, the sand passageway 70 extends generally centrally through the tube 58, the sand inlet 72 is formed by the upper end of the tube 58, and the sand outlets 74 are formed on the slanted surface of the lower tapered portion 66, whereby sand is blown out in an angular fashion. (See also FIGS. 2A and 2D.)

During sand-blowing steps, sand is blown from the sand magazine 12 with compressed air, flows through the sand inlet 72, continues down through the center of the tube 58 (i.e., the passageway 70), and exits the tube 58 through the sand outlets 74. The sand outlets 74 feed the sand into and through a space around the tube 58 and within the outer tube 60.

The annular wall of the of the inner tube 58 also defines catalyst passageways 76, which extend from catalyst inlets 78 that communicate with the manifold chamber 30 to catalyst outlets 80. In the illustrated embodiment, the catalyst inlet 78 is formed by a circumferential groove in the annular wall, the catalyst outlets 80 are formed on the flat wall 69 within the tip 68 of the lower portion 66 inside the sealing diameter, and the catalyst passageways 76 are formed within the tube's annular wall and extend between respective inlets 78 and outlets 80. (See also FIGS. 2B–2E.)

Figure 3:
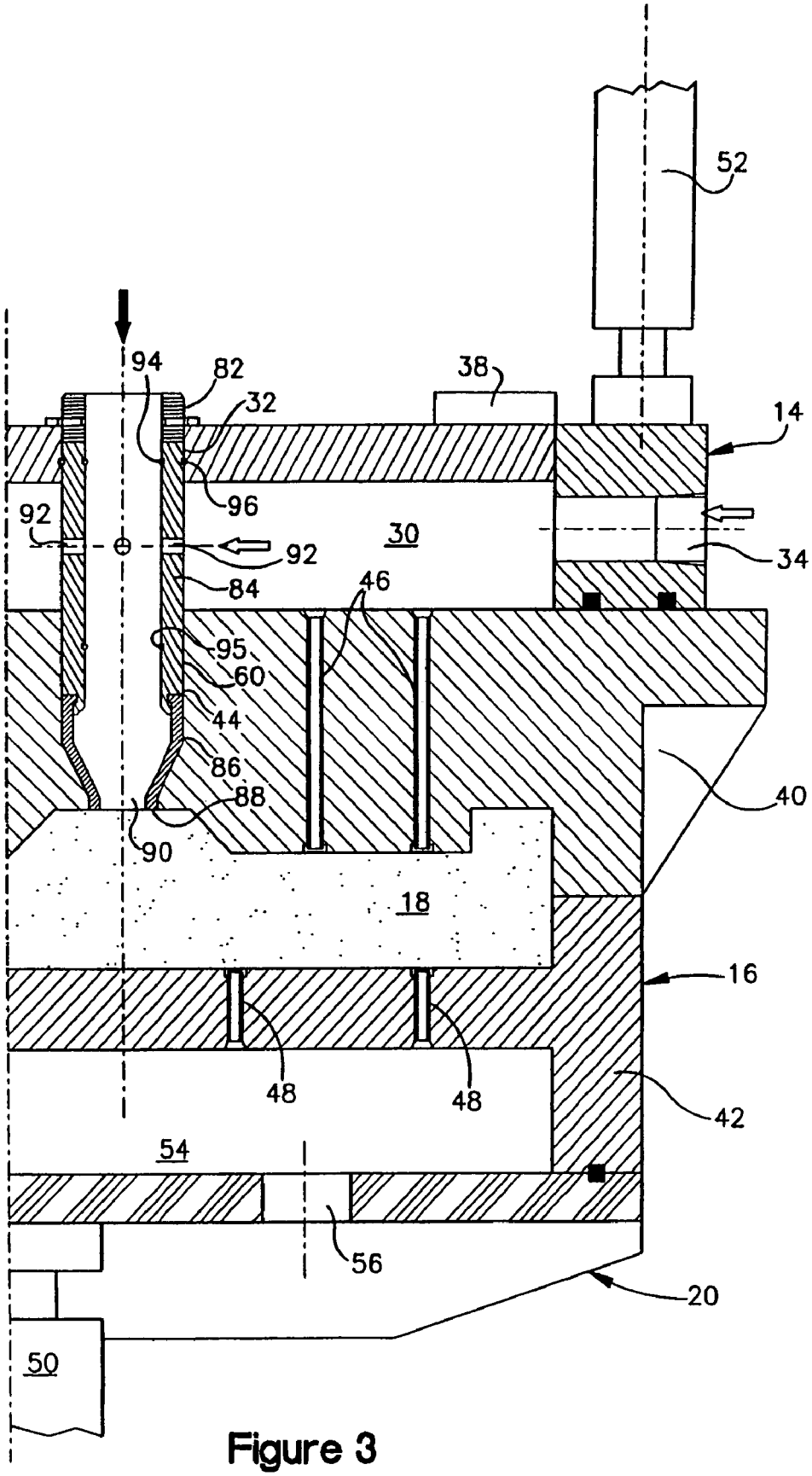
FIG. 3 is an enlarged side schematic view of another component of the sand-forming apparatus, namely an outer blow tube.

Referring now to FIG. 3, the outer tube 60 is shown isolated from the inner tube 58, and the manifold 14 and the core box 16 are shown isolated from the magazine 12. In the illustrated embodiment, the outer tube 60 comprises an upper threaded portion 82, a central portion 84, and a lower portion 86. The threaded portion 82 can be screwed into the manifold opening 32 and held in place with a lock nut. (It again may be noted that a threaded mounting arrangement allows adjustment of the height of the outer tube 60 and sets the depth into the cope 40.) The central portion 84 extends through the opening 34 in the manifold 14, through the manifold chamber 30, and partially through the cope 40. The lower portion 86 is positioned within the cope 40 and is fitted with a blow tip 88 that seals against the cope 40. The tip 88 can be made of rubber or another pliable material that can withstand relevant catalyst or resin deterioration and blowing sand friction.

The annular wall of the outer tube 60 defines an interior space for the inner tube 58, and this space terminates in a bottom outlet 90. Radial catalyst inlet openings 92 extend through the annular wall in the central portion 84, thereby allowing communication between the manifold chamber 30 and the interior space of the outer tube 60. The inner surface of the tube's annular wall seats sealing O-rings 94 and 95 above and below, respectively, the radial inlet openings 92. The outer surface of the tube's annular wall seats sealing O-ring 96 above the radial inlet openings 92. When the inner tube 58 is in its sand-blowing position relative to the outer tube 60 (FIGS. 1A and 4), the radial inlet openings 92 are offset from (e.g., below) the inlet groove 78 in the inner tube 58. When the inner tube 58 is in its catalyst-introducing position relative to the outer tube 60 (FIGS. 1B and 4B), the radial inlet openings 92 are aligned with the inlet groove 78 in the inner tube 58.

Figure 4A:
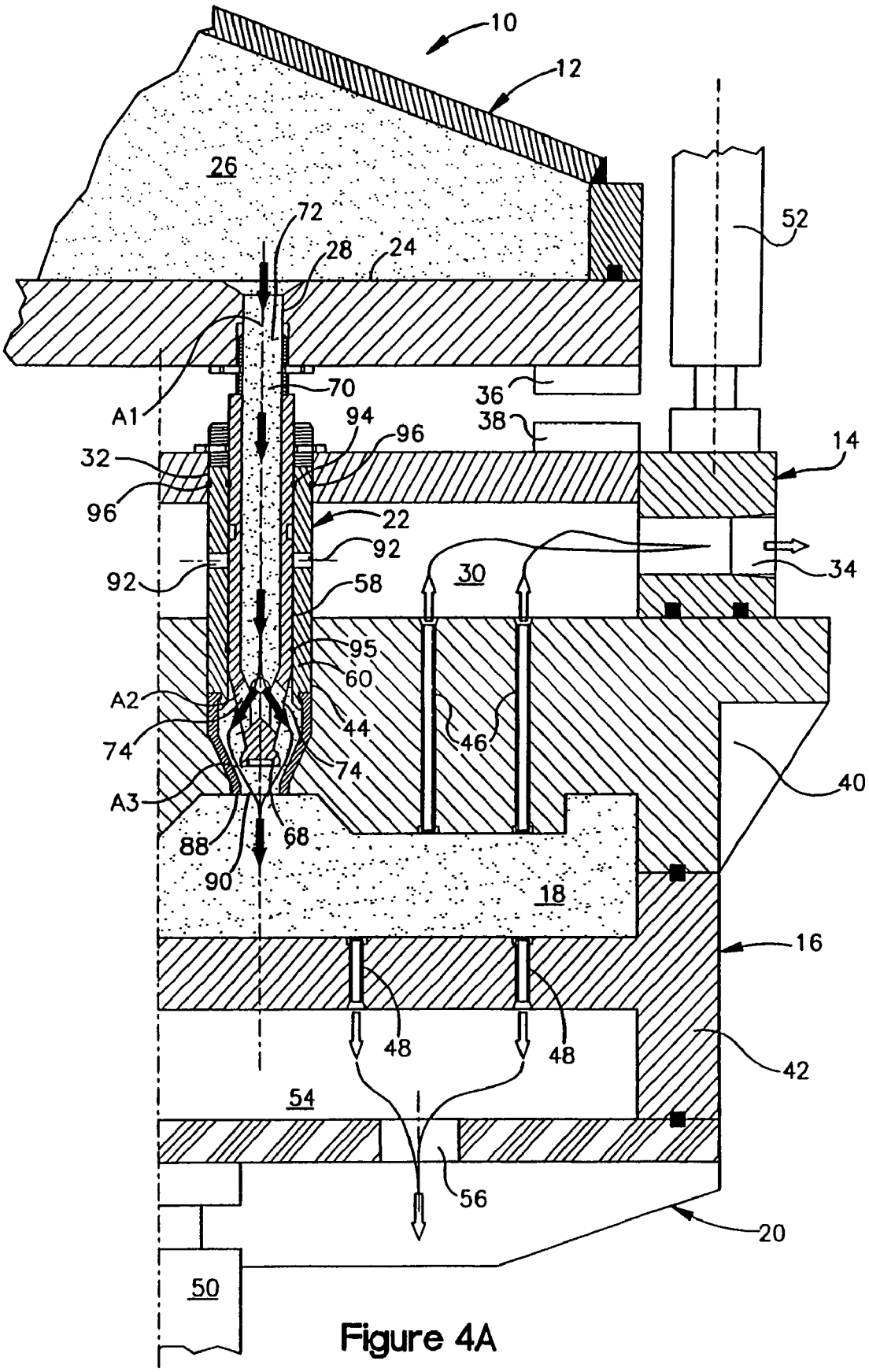
FIGS. 4A and 4B are side schematic views showing flow patterns when the sand-forming apparatus is in its sand-blowing state and its catalyst-introducing state, respectively.
Figure 4B:
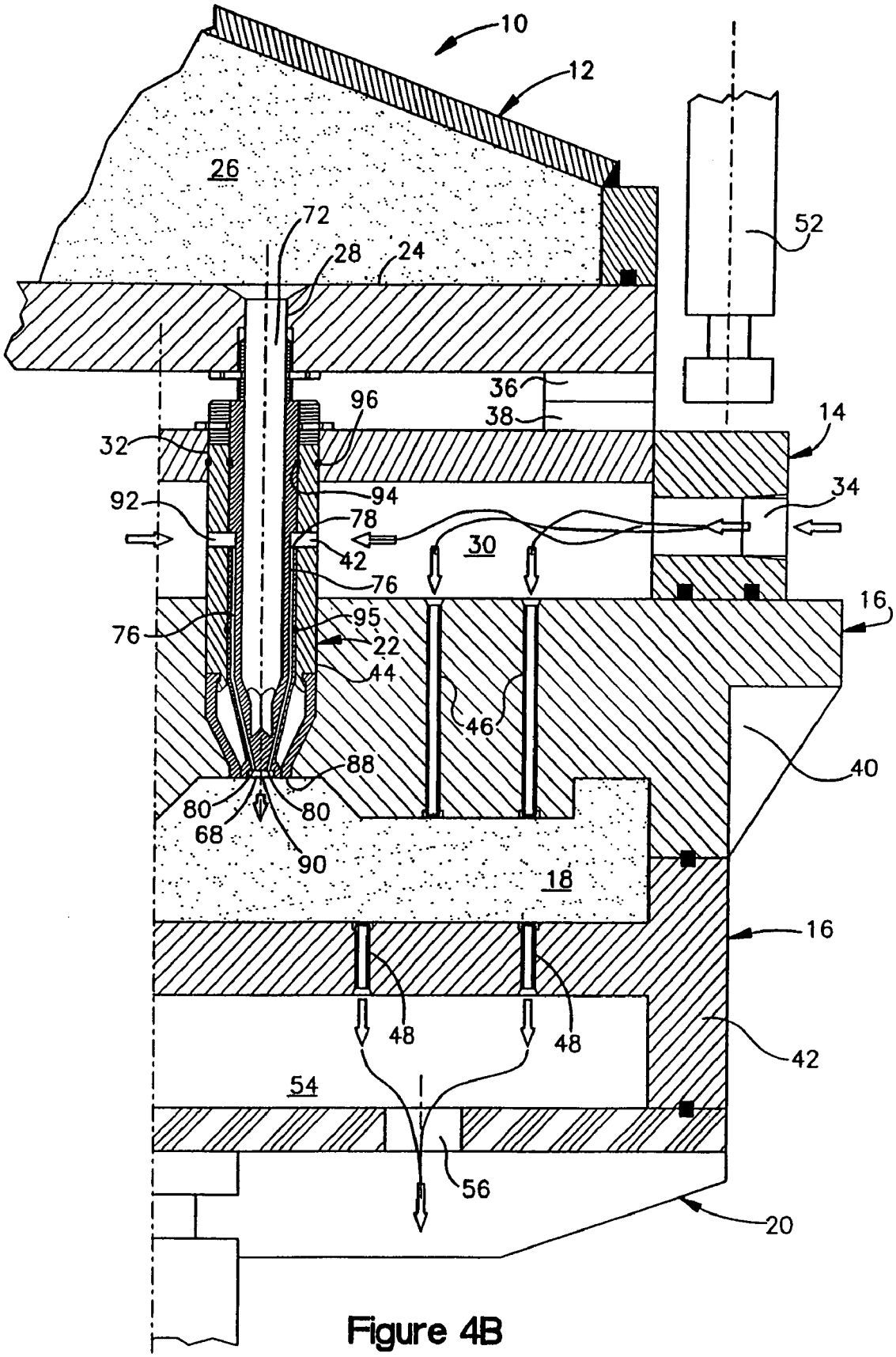

Referring now to FIGS. 4A and 4B, the flow patterns for the sand-forming apparatus 10 when in its sand-blowing state and its catalyst-introducing state, respectively, are schematically shown.

In the sand-blowing state, the magazine 12 and the manifold 14 are separated from each other, whereby the inner tube 58 is elevated relative to the outer tube 60 and whereby the inner tip 68 is elevated relative to the outer tip 88. The circumferential catalyst inlet groove 78 on the inner tube 58 is positioned above the radial catalyst inlets 92 on the outer tube 60, and the O-rings 94 and 96 seal off any communication from the manifold chamber 30. Sand is conveyed (e.g., blown with compressed air) from the sand magazine 12 through the sand passageway 70 in the inner tube 58, through the sand outlets 74, into the tip 88 of the outer tube 60, and into the cavity 18. (See solid arrows in FIG. 4A.) To assure adequate flow areas through the relative passageways during the sand-blowing state, the inlet area into the tube 58 (A1) should equal the outlet area (A2× number of outlets 74) and should equal the clearance area between the tube 58 and the tube 60 (A3), with friction and other flow losses being factored into the equation.

As the blown sand fills the cavity 18, the air volume it is replacing, as well as the air blown with the sand, escapes through the cope vent passages 46 and the drag vent passages 48. The cope passages 46 convey the exhaust air to the manifold chamber 30 so that it can exit through the manifold inlet/outlet ports 34. The drag passages 48 convey the exhaust air to the exhaust chamber 54 so that it can exit through the table exhaust outlets 56 and to, for example, a scrubber. (See hollow arrows in FIG. 4A.) To aid the exhaust of air, the exhaust side of the exit vents 56 can be drawn with a vacuum (e.g., −1 psia).

After filling the cavity 18 with sand and exhausting the corresponding trapped air, the clamped tooling package (i.e., the manifold 14, the cope 40, and the drag 42) can be raised until the magazine stops 36 and the manifold stops 38 are engaged. Alternatively, the magazine 12 can be lowered to the same relative position. In either case, the cope 40 and the drag 42 remain stationary relative to each other, and the manifold 14 remains stationary relative to the core box 16, throughout the state-converting process. This is particularly significant prior to and during the catalyst-introducing steps so as to avoid disturbance of the uncured core with machine motions.

Movement of the inner tube 58 to its catalyst-introducing position results in the blown sand below the inner tube's closed tip 68 being compacted evenly (or tamped) with the top surface profile of the now sand-filled cavity 18. This allows for a smooth core surface that will not require either cleaning of the core or cause a defect in the finished casting. The tamping height is dictated by the separated distance between the magazine stops 36 and the manifold stops 38. Also, as was indicated above, the tamping height can be adjusted accurately via the threaded mounting of the inner tube 58 and/or the outer tube 60.

In the catalyst-introducing state, the tip 68 of the inner tube 58 is vertically aligned and sealed with the tip 88 of the outer tube 60, and is situated flush against the cope entrance into the cavity 18. In this manner, the tip's sealing diameter forms a barrier around the catalyst outlets 80, thereby preventing any catalyst flow therefrom to the sand outlets 74. Also, the radial inlets 92 in the outer tube 60 are aligned with the circumferential inlet groove 78 in the inner tube 58. The lower sealing O-ring 95 prevents any catalyst communication with the sand outlets 74, and the upper sealing O-ring 94 prevents any catalyst leakage around the upper portion of the inner tube 58.

During the catalyst-introducing steps, catalyst (supplied, for example, from a gas generator) passes through the manifold ports 34 into the manifold chamber 30, through the radial inlets 92 in the outer tube 60, into the circumferential inlet groove 78 in the inner tube 58, through the catalyst passageways 76 to the outlets 80, and into the sand-shape now occupying the cavity 18. Catalyst also may flow from the manifold chamber 30 through the cope passages 46 into the cavity 18. The catalyst flows through the sand-shape in the cavity 18 and exits through the drag passages 48, into the exhaust chamber 54, and exits through the table exhaust vents 56. The catalyst may be introduced at an elevated temperature and pushed by a raised inlet pressure and/or pulled by a negative outlet pressure through the exhaust vents 56. (See hollow arrows in FIG. 4B.)

As the catalyst travels through the cavity 18 and flows through the body of the sand-shape, it cures or hardens the core through a chemical reaction. During this reactive catalyst-introducing stage, the sand remaining in the blow tube assembly 22 is isolated from the catalyst. This isolation is important, in that the excess sand needs to remain flowable and uncured for the sand-forming of subsequent cycles. (If the sand cures inside the blow tube assembly 22, its removal can be extremely difficult, and sometimes impossible, without destroying or damaging the equipment.) Additionally or alternatively, the blow tube assembly 22 replicates the best in tamper pin designs by allowing the catalyst to be introduced at approximately the same place as that which the blown sand had previously been introduced into the cavity 18.

Upon completion of the catalyst-introducing steps, and after an appropriate curing time, a purging process can be performed. The purging fluid (e.g., compressed air) flows in the same path as the catalyst. Specifically, the purging fluid passes through the manifold ports 34 into the manifold chamber 30 and through the cope passageways 46, and then exits through the drag passages 48. (See hollow arrows in FIG. 4B.) After purging, the core box 16 may be separated, and the core is available for ejection and removal.

One now may appreciate that the present invention provides a sand-forming apparatus 10, wherein sand-blowing steps and catalyst-introducing steps can be performed without removal of the blow tube assembly 22. In this manner, alignment of the manifold 14, the core box 16, the blow tube assembly 22, and the blow plate 24 is assured, since there is no need for re-alignment after removal and before re-insertion of the blow tube assembly.

One also now may appreciate that the present invention provides a sand-forming apparatus 10 wherein conversion to the catalyst-introducing state can be accomplished without un-clamping the manifold 14 from the core box 16 and without shuttling the manifold 14 to a remote position. As was indicated above, this eliminates relative movement between the manifold 14 and the core box 16, thereby avoiding disturbance of the as-yet-uncured core. Additionally, this design eliminates the need for the shuttle for the manifold, whereby less floor space and a smaller footprint are necessary to accommodate the sand-forming apparatus 10. Furthermore, residual catalyst gas can remain contained more easily in the manifold 14.

One now may appreciate further that the sand-forming apparatus 10 requires a comparatively short movement of the sand magazine 12 relative to the manifold 14 and core box 16. This dramatically decreases the overall height of the apparatus 10 and also drastically reduces hydraulic requirements in connection with the clamp table 20. With particular reference to the clamp table 20, the stroke of the table cylinder 50 can be significantly shortened, thereby reducing wear-and-tear on the overall apparatus and notably curtailing maintenance needs/costs. By reducing mechanical dry cycle times of the core machines, a faster core to core cycle time and increased productivity can be realized. For example, while a conventional sand-forming apparatus may dictate a stroke in the range of fifty inches, the sand-forming apparatus 10 of the present invention can be operated with a stroke in the range of twelve inches.

One now may appreciate still further that the sand-forming apparatus 10 is compatible with existing core box equipment. This allows an existing conventional sand-forming apparatus to be converted into the sand-forming apparatus 10 of the present invention without having to completely replace a company's current set of core boxes. Specifically, this conversion could be accomplished by removing the existing manifold and blow tube assembly, securing the manifold 14 to the core box 16, and inserting the blow tube assembly 22 through the aligned openings in the blow plate 24, the manifold 14, and the core box 16.

Although the invention has been shown and described with respect to certain preferred embodiments, it is apparent that equivalent and obvious alterations and modifications will occur to others skilled in the art upon the reading and understanding of this specification. The present invention includes all such alterations and modifications and is limited only by the scope of the following claims.

The invention claimed is:

1. A method of casting a metal part, said method comprising the steps of:

forming a sand-shape with a sand-forming apparatus comprising a core box comprising a cavity having a shape corresponding to a desired sand-shape, and a blow tube assembly comprising a sand passageway through which sand is blown into the cavity, a catalyst passageway for introducing catalyst into the sand blown into the cavity, and a seal between the sand passageway and the catalyst passageway, whereby sand in the sand passageway is isolated from catalyst in the catalyst passageway, wherein the blow tube assembly comprises an inner tube and an outer tube, which at least partially surrounds the inner tube, said forming step comprising the steps of:

converting the apparatus to a sand-blowing state, whereat the sand passageway communicates with the cavity in the core box;

blowing sand into the cavity;

converting the apparatus to a catalyst-introducing state, whereat the catalyst passageway communicates with the cavity in the core box; and introducing catalyst into the sand blown into the cavity;

casting the metal part, this step comprising pouring molten metal into or around the sand-shape; and removing the sand-shape from the metal part.

2. A method as set forth in claim 1, wherein a manifold remains clamped to the core box during said converting, blowing, and introducing steps.

3. A method as set forth in claim 2, further comprising the step of venting exhaust air through the manifold during said blowing step.

4. A method as set forth in claim 3, further comprising the step of purging the catalyst after the catalyst introducing step, and wherein the purging fluid passes through the manifold.

5. A method as set forth in claim 4, further comprising the step of tamping excess sand after said sand-blowing step, and wherein said tamping step is accomplished by relative movement between an inner tube and an outer tube of the blow tube assembly.

6. A method as set forth in claim 1, further comprising the step of tamping excess sand after said sand-blowing step, and wherein said tamping step is accomplished by relative movement between the inner tube and the outer tube of the blow tube assembly.

7. A method as set forth in claim 1, wherein, when the apparatus is in its sand-blowing state, the sand passageway communicates with the cavity and the catalyst passageway is sealed from a catalyst supply, and wherein, when the apparatus is in its catalyst-introducing state, the catalyst-introducing passage communicates with the catalyst supply and the sand passageway is sealed from the cavity.

8. A method as set forth in claim 7, wherein relative movement between the inner tube and the outer tube converts the apparatus between the sand-blowing state and the catalyst-introducing state.

9. A method as set forth in claim 8, wherein the inner tube defines the sand passageway and the catalyst passageway.

10. A method as set forth in claim 9, wherein the inner tube comprises an annular wall, and wherein an inner surface of the annular wall forms the sand passageway.

11. A method as set forth in claim 10, wherein the sand passageway comprises a sand inlet and a sand outlet, wherein the sand inlet is formed by a top edge of the annular wall, and wherein the sand outlet is formed by an opening in a side portion of the annular wall.

12. A method as set forth in claim 11, wherein the area of the sand inlet is equal to the area of the sand outlet, with friction and other flow losses being factored into consideration.

13. A method as set forth in claim 12, wherein the outer tube has an exit which communicates with the cavity, and wherein the sand outlet communicates with the exit.

14. A method as set forth in claim 13, wherein a clearance area between the outer tube and the inner tube approximately equals the area of the sand inlet and the area of the sand outlet, with friction and other flow losses being factored into consideration.

15. A method as set forth in claim 11, wherein the sand outlet comprises a plurality of sand outlets, which are each formed by an opening in a side portion of the annular wall.

16. A method as set forth in claim 9, wherein the inner tube comprises an annular wall, and wherein the catalyst passageway is formed within the annular wall.

17. A method as set forth in claim 16, wherein the catalyst passageway comprises a catalyst inlet and a catalyst outlet, wherein the catalyst inlet is defined by a passageway in the annular wall, and wherein the outer tube provides a path from a catalyst supply to the catalyst inlet in the inner tube.

18. A method as set forth in claim 17, wherein the path from the catalyst supply to the catalyst inlet is blocked when the assembly is in its sand-blowing position and is open when the assembly is in its catalyst-introducing position.

19. A method as set forth in claim 17, wherein the inner tube comprises a tip having a sealing diameter, and wherein the catalyst outlet is positioned within the sealing diameter.

20. A method as set forth in claim 1, wherein said removing step comprises breaking down, shaking out or de-solidifying the sand shape.

* * * * *